United States Patent [19]

Pieprzak et al.

[11] Patent Number: 4,867,113

[45] Date of Patent: Sep. 19, 1989

[54] REDUCED FRICTION ENGINE TAPPET CONSTRUCTION

[75] Inventors: John M. Pieprzak, Dearborn; Pierre A. Willermet, Livonia, both of Mich.

[73] Assignee: Ford Motor Company, Dearborn, Mich.

[21] Appl. No.: 290,115

[22] Filed: Dec. 27, 1988

[51] Int. Cl.[4] ..... F01L 1/16; F01L 1/24

[52] U.S. Cl. ..... 123/90.49; 123/90.55

[58] Field of Search ..... 123/90.35, 90.41, 90.48, 123/90.49, 90.52, 90.55, 90.56, 90.57, 90.2, 90.27

[56] References Cited

U.S. PATENT DOCUMENTS

| | | | |
|---|---|---|---|
| 2,925,808 | 2/1960 | Baumann | 123/90.48 |
| 3,406,668 | 10/1968 | Donnelly et al. | 123/90.55 |
| 3,598,095 | 8/1971 | Ayres | 123/90.35 |
| 3,875,911 | 4/1975 | Joseph | 123/90.35 |
| 3,967,602 | 7/1976 | Brown | 123/90.35 |
| 4,227,495 | 10/1980 | Krieg | 123/90.55 |
| 4,498,432 | 2/1985 | Hara et al. | 123/90.55 |
| 4,561,393 | 12/1985 | Kopel | 123/90.55 |
| 4,589,383 | 5/1986 | Showalter | 123/90.46 |
| 4,798,180 | 1/1989 | Okabe et al. | 123/90.55 |

*Primary Examiner*—Charles J. Myhre
*Assistant Examiner*—Weilun Lo
*Attorney, Agent, or Firm*—Clifford L. Sadler; Jerome R. Drouillard

[57] ABSTRACT

An engine tappet is constructed with flat, essentially parallel or conformal bearing surfaces internal of its case for the introduction during no-load operation of a lubricant under pressure to the space between the surfaces, the pressure level of the lubricant being greater than the force necessary to remove lash in the system, to thereby create an oil film between the surfaces that is partially squeezed out during load operations of the cam event to in effect float one part upon the other to reduce rotational friction.

6 Claims, 4 Drawing Sheets

COLLAPSE OF A SQUEEZE FILM UNDER APPLIED LOAD

REDUCED FRICTION ENGINE TAPPET CONSTRUCTION

This invention relates in general to an automotive type internal combustion engine, and more particularly, to the construction of a tappet assembly to reduce friction between the rotating parts.

Cam/tappet friction can be reduced by promoting tappet rotation. The ideal rotation speed would be that at which the surface velocities of the cam and tappet surfaces are the same. Friction is reduced in two ways: (1) By increasing the oil film thickness, thus decreasing the degree of contact between the cam and tappet surfaces, and (2) by introducing a rolling motion between the surfaces, coefficients of rolling friction being lower than those of sliding friction. This will be true for a wide range of valve train geometries, including the center pivot rocker arm example shown in FIG. 1.

This invention promotes tappet rotation by reducing the frictional resistance to tappet rotation. This is accomplished by introducing a squeeze film bearing between the relative rotating parts, such as the end cap and the check valve body in a hydraulic type tappet.

Squeeze films are lubricating films between two bearing surfaces. These can be produced in several ways: by forcing oil between the surfaces at a pressure large enough to overcome the load on the bearing surfaces, or by allowing oil to flow into the area between the bearing when the bearing is unloaded. When the bearing is loaded or when the pressure forcing oil into the gap is less than the pressure on the bearing, the oil is squeezed out of the bearing. As the oil film becomes thin, the rate at which it is squeezed out becomes progressively less. Accordingly, such films can last for a considerable time. If the bearing surfaces are smooth, very thin oil films can completely separate the two bearing surfaces. This allows the surface to move easily, i.e., with low friction relative to one another.

The invention to be described to reduce friction by improving tappet rotation, as stated previously, relies on a squeeze film of engine oil between two bearing surfaces inside the tappet. In the case of a mechanical tappet, the load over the base circle is nearly zero. Therefore, only a small bearing area is needed to form an oil film. In the case of a hydraulic tappet, a significant load is produced when the cam/tappet contact is on the base circle because of the hydraulic pressure in the tappet used to pump up the tappet to maintain contact with the cam base circle. The invention takes advantage of this by using this oil under pressure to force oil between two smooth bearing surfaces incorporated in the bearing.

After an oil film is formed at the load bearing surface, the cam/tappet contact moves over the cam event and the contact becomes loaded but the oil cannot be squeezed out in the time allowed by the event. Accordingly, the tappet can rotate freely, which reduces friction.

It is a primary object of the invention, therefore, to provide an automotive engine tappet construction that utilizes a squeeze film of lubricant principle to reduce frictional resistance to rotation between the parts.

It is another object of the invention to provide a tappet of the construction described above in which a thin film of lubricant is introduced between two smooth bearing surfaces to in effect floatingly mount the parts relative to each other to reduce friction.

Other objects, features and advantages of the invention will become more apparent upon reference to the succeeding, detailed description thereof, and to the drawings illustrating the preferred embodiments thereof, wherein:

FIG. 1 schematically illustrates a side elevational view of a valve train embodying the invention;

Figure 1:
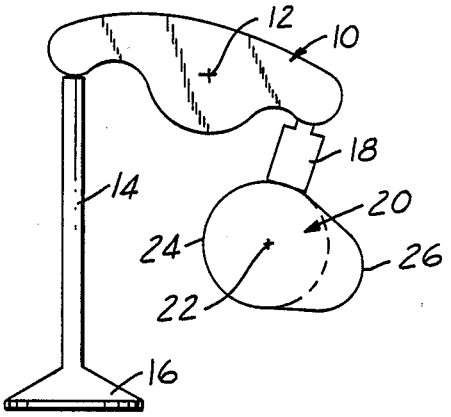

FIG. 1 illustrates an essentially conventional valve train assembly consisting of a rocker arm 10 oscillatable about a fulcrum 12 to reciprocate the stem 14 of a valve 16 in the usual manner. The opposite end of the rocker arm is actuated by a tappet assembly 18 that rides on the surface of a cam member 20 fixed for rotation on a camshaft having an axis 22. The cam member in this case has a base circle portion 24 and a contoured cam surface portion 26 for loading the tappet against the rocker arm to actuate the valve. The cam/tappet contact would be made off center of the tappet face to impose a turning torque on the tappet upon rotation of the cam member.

Figure 2:
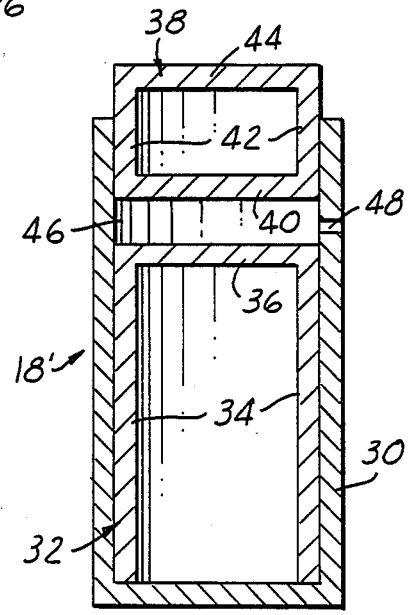
FIG. 2 is a cross-sectional schematic view of a mechanical tappet embodying the invention.

FIG. 2 illustrates a mechanical tappet 18' construction that employs the squeeze film lubricant principle. As shown, the tappet includes an outer tubular channel or cup-shaped case 30 within which is fixed a second tubular channel or cup-shaped member 32 having side leg portions 34 and a flat, smooth round bottom portion 36. Facing the bottom portion 36 is a cylindrical cap member 38 having a mating flat round bottom plate 40 and side and top surface portions 42, 44. The channel member 32 in this case is shown with a press fit; however, it will be clear that it could be secured in the outer case 30 by other methods.

The cap member 38 is slidably received within the outer case 30 and movable with respect to the member 32 to define a fluid lubricant or oil chamber 46 between the two flat bearing surfaces 36, 40. An oil or lubricant supply hole 48 is adapted to be connected to a suitable source of lubricant under pressure, such as the engine oil pump, for example.

Figure 4:
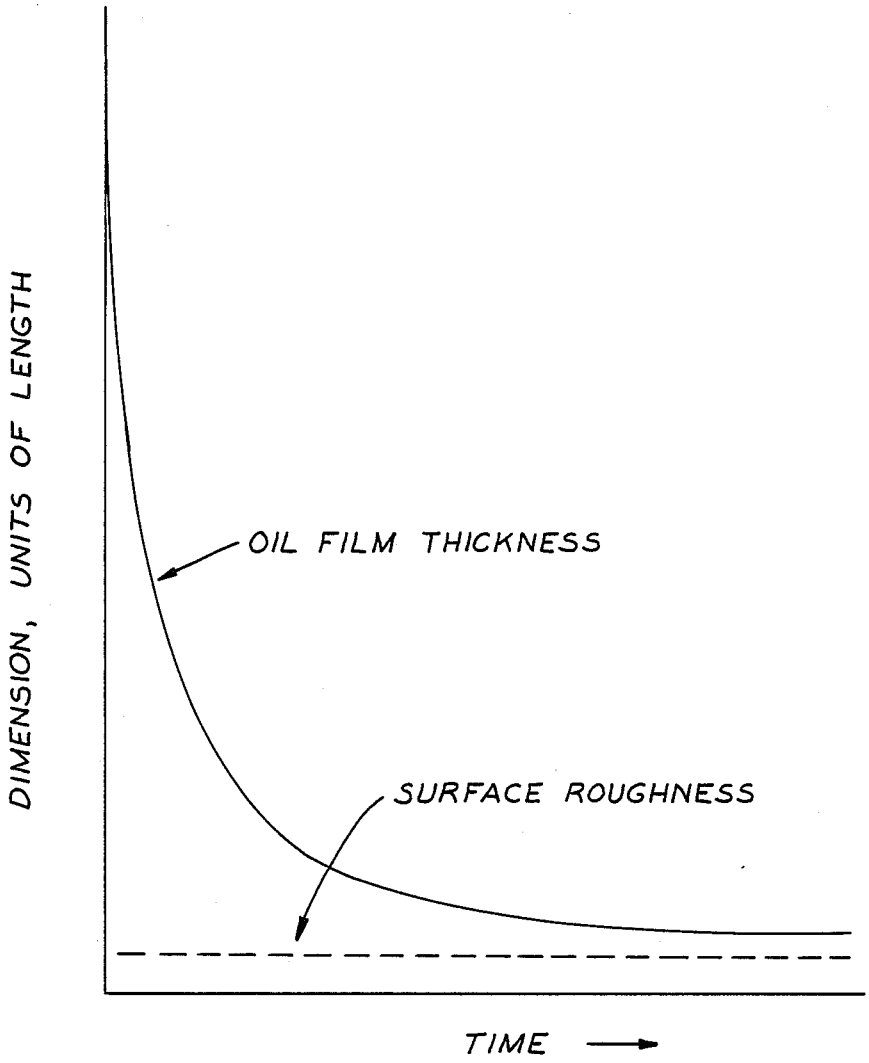
FIGS. 4, 5 and 6 are graphical illustrations showing various squeeze film characteristics.

The pressure level of the lubricant entering the chamber 46 required must be sufficient to provide a force greater than the forces pressing the tappet against the end of the rocker arm when the tappet contacts the cam on the base circle. Also, the two facing end surfaces 36, 40 should be made smooth. In the case illustrated, the bottom 40 of the end cap 38 and the bottom 36 of the channel-shaped member 32 are made flat, then polished to a surface finish of about 2 micro inches with a very slight crown. A slight crown is desirable to avoid contact at sharp edges. The fine surface finish allows the squeeze film to last longer before the oil film thickness becomes comparable in dimensions to the surface toughness. FIG. 4 illustrates the rate of collapse of an oil film thickness with time and its approach to the surface roughness of the adjacent parts.

After an oil film is formed at the load bearing surfaces 36, 40 in chamber 46, the cam/tappet contact moves over the cam event in which the contoured cam portion 26 of the cam member moves the tappet assembly through its load operation, causing higher loads to be applied to the tappet assembly. The oil film then is gradually squeezed out by means of leakage past the side portions 42 of the end cap, to decrease the oil film thickness. It will be clear, however, that such leakage is not necessary for operation under this principle to reduce friction.

Figure 3:
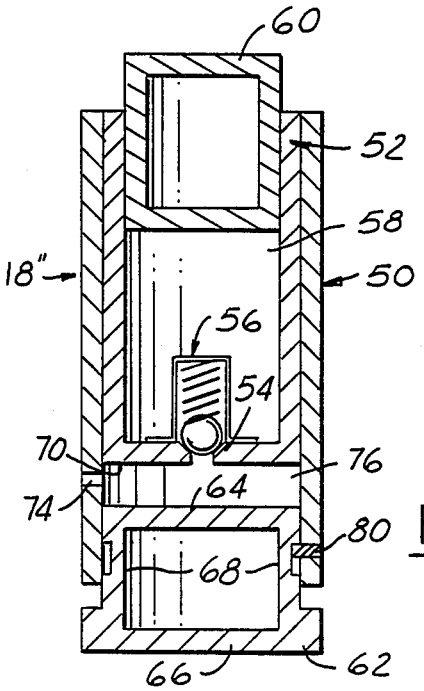
FIG. 3 is a cross-sectional schematic view of a hydraulic tappet embodying the invention.

FIG. 3 illustrates schematically a hydraulic tappet construction with the squeeze film bearing principle incorporated. In this case, the tappet is constructed in a manner similar to a conventional hydraulic tappet, with an outer cylindrical case 50 receiving therein with a press-fit a cylindrical channel-shaped check valve body 52. The latter has an axial or central opening 54 for the flow of oil or lubricant past a ball-type pressure relief valve 56 controlling the inlet of lubricant to a chamber 58. An end cap member 60, slidably received within the check valve body 52, is adapted to engage the end of the rocker arm shown in FIG. 1.

The opposite end of the case 50 contains a second cylindrical end cap member 62 slidably received within the end of the tappet case 50, as shown. It has opposite flat or crowned, round faces 64 and 66 and side walls 68, forming a hollow hat-shaped element. The bottom round face 70 of the check valve body is also made flat in a manner mating that of the bottom or end plate 64, the two being ground smooth in a manner similar to that described in connection with the solid tappet.

An oil or lubricant supply hole 74 is provided in the side of the tappet case as an inlet for the oil or lubricant under pressure. The pressure level must be sufficient to pump up the tappet by admitting oil past the pressure relief valve so that the end caps 60, 62 engage the ends of the rocker arm and cam in a manner eliminating lash. It will also be clear that the pressure level in the chamber 76 defined between the two end plates 70 and 64 must provide a force greater than just the forces exerted by the cam on the tappet against the rocker arm sufficient to eliminate the lash, thereby providing a squeeze film of lubricant between the two facing end plates 70 and 64. This in effect floatingly mounts the end cap 62 with respect to the check valve body 52 on a thin film of lubricant or oil. A load that is produced by this oil under pressure times the area of the end cap separates the components and creates the oil film.

Figure 5:
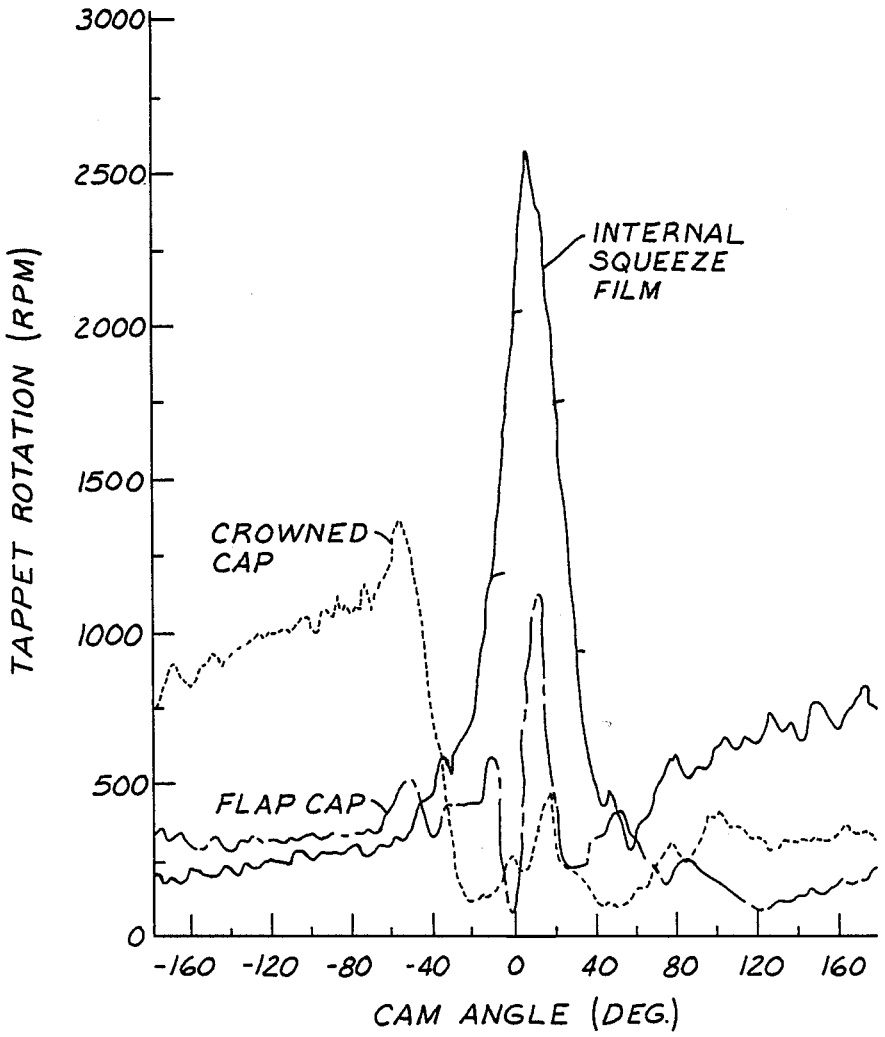
Figure 6:
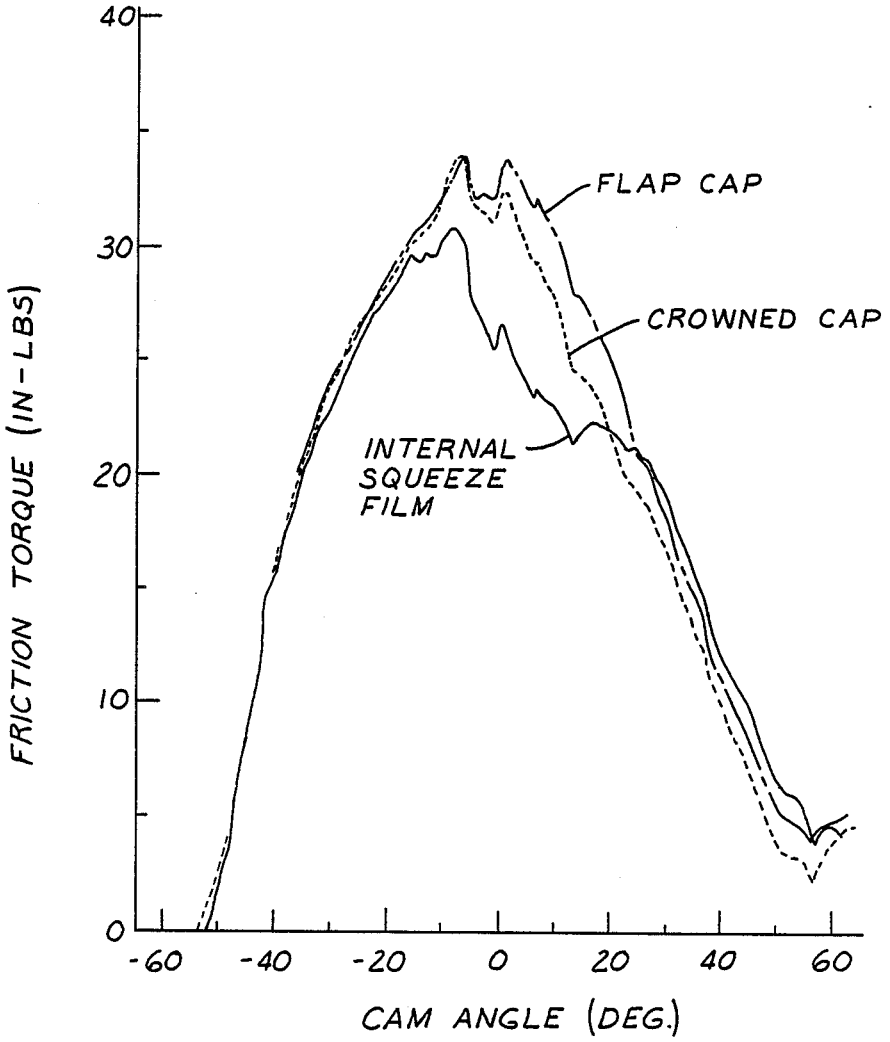

The thickness of the oil film in this configuration is dictated by the valve lash. Oil pressures normally encountered in engines, about 10 psi at low idle, higher at higher speeds, are more than adequate to create this oil film. As the contact moves off the base circle and over the cam event, the load on the cam tappet contact increases and becomes greater than the load produced by the oil pressure. The oil is then squeezed out of the contact. However, if the surface finish is sufficiently smooth, the oil film endures until the contact is once again on the base circle. At that point, the process is repeated. Experimental results were obtained in a cam/-tappet friction rig derived from an engine with a center pivot rocker arm geometry. FIG. 5 shows that the internal squeeze film tappet described above produced much higher rotational speeds. In FIG. 5, the curve labelled "flat cap" denotes results for a standard or conventional production tappet. The cam event is over the interval of approximately −65 to +65 degrees. The point of maximum lift is at 0 degrees. FIG. 6 shows friction torque as a function of cam angle. The internal squeeze film tappet shows lower friction losses.

One limitation on tappet speed is the rotational inertia of the tappet. That is, at higher speeds, the tappet cannot change rotational speed fast enough to follow the motion of the cam. This limits the degree of friction reduction obtainable at higher speeds. FIG. 3 shows an approach to extending the speed range by reducing the rotational inertia and how this may be incorporate into a hydraulic tappet configuration. This is done by having the separate rotating tappet face in the tappet, which has a lower rotational inertia, and a balance of forces on the base circle, which pumps-up the hydraulic tappet while also creating the oil film required for the squeeze film. The balance of forces in this particular design is obtained by sizing the squeeze film bearing larger than the end cap area so that on the base circle the rotating tappet face is forced up against the squeeze film stops 80, creating the oil film needed, while the end cap 60 is forced up against the rocker arm, taking up any valve lash. Experimental data have not been obtained for this design.

Test data obtained on a construction of this type were obtained with the ASTM 20W30 reference oil HR-4. Oil viscosity would have only a minor effect on performance of the squeeze film bearing over the range of viscosities found for practical engine oils at operating temperatures. Hydraulic valves often are not completely pumped up at very low ambient temperatures until the oil is warm. Since the passages used to fill the tappets are reasonable large, the tappets should normally fill in a fraction of the time available on the base circle. As the squeeze film thickness becomes small, the rate of film collapse becomes slower.

While the invention has been shown and described in its preferred embodiments, it will be clear that many changes and modifications may be made thereto without departing from the scope of the invention.

We claim:

1. A tappet construction for the valve train of an internal combustion engine having an element of the valve train engaged by the tappet for moving the same, the tappet having an outer cup-shaped case member with side walls and an essentially flat bottom wall adapted to be engaged by a rotating cam member, the cam member having a circumferential base circle no-load portion and a contoured cam circumferential load portion, the cam member engaging the bottom wall to one side of its center to impart a rotative torque on the case, the case slidably and rotatably receiving therein in back-to-back relationship first and second channel-like members each having spaced side walls joined by a continuous essentially flat end wall, the first member being engageable by a portion of the engine element, the flat end walls of the members being adjacent one another and movable relative to each other to at times form a fluid chamber therebetween, a fluid inlet to the chamber and a source of fluid lubricant under pressure connected to the inlet for supplying lubricant at a pressure level greater than the force of the element and cam member against the first member and case to thereby effect separation of the end walls by a film of lubricant thereby reducing frictional resistance to rotation between the parts, the fluid under pressure being introduced during the no-load operation of the valve train when the case bottom wall is in contact with the base circle portion of the cam member, the fluid being partially squeezed from the chamber during the load condition of operation of the valve train when the case bottom wall is in contact with the contoured cam portion of the cam member to provide a thin film of lubricant between the flat end walls.

2. A tappet as in claim 1, the first member comprising an end cap closed at both ends, the second member being hollow and including an opening in its end wall containing a spring closed pressure relief valve operable above a predetermined pressure in the chamber to admit lubricant to the interior of the second member , the opposite end of the second member slidably receiving therein a second end cap member having a flat bottom wall actuated by the lubricant admitted to the interior to move the second end cap against the valve train element to reduce the lash between the element and cam member.

3. A tappet as in claim 1, wherein the case and first and second members constitute a solid tappet.

4. A tappet as in claim 2, wherein the case and other members constitute a hydraulic tappet.

5. A tappet as in claim 2, including means between one of the members and the case limiting the sliding relative movement between the one member and the case.

6. A tappet as in claim 1, wherein the adjacent end walls are smooth.

* * * * *